United States Patent [19]

Steiger et al.

[11] Patent Number: 4,803,151

[45] Date of Patent: Feb. 7, 1989

[54] PHOTOGRAPHIC MATERIAL FOR THE SILVER DYE BLEACH PROCESS COMPRISING AN AZO DYE, CAPABLE OF LAKING, IN GELATINE

[75] Inventors: Rolf Steiger, Praroman; Matthias Schellenberg, Marly, both of Switzerland

[73] Assignee: Ciba-Geigy AG, Basel, Switzerland

[21] Appl. No.: 13,419

[22] Filed: Feb. 11, 1987

[30] Foreign Application Priority Data

Feb. 11, 1986 [CH] Switzerland ..... 536/86

[51] Int. Cl.[4] ..... G03C 7/32

[52] U.S. Cl. ..... 430/562; 430/561; 430/222; 430/225; 430/546; 430/559

[58] Field of Search ..... 430/561, 562, 563, 225, 430/559, 546, 222

[56] References Cited

U.S. PATENT DOCUMENTS

| | | | |
|---|---|---|---|
| 2,075,190 | 3/1937 | Gaspar | 95/7 |
| 2,137,336 | 11/1938 | Gaspar | 95/2 |
| 2,368,647 | 2/1945 | Dreyfuss | 95/8 |
| 3,931,142 | 1/1976 | Lenoir et al. | 430/561 |

FOREIGN PATENT DOCUMENTS

| | | |
|---|---|---|
| 676109 | 5/1939 | Fed. Rep. of Germany . |
| 67740 | 7/1939 | Fed. Rep. of Germany . |
| 415756 | 9/1934 | United Kingdom . |
| 434305 | 8/1935 | United Kingdom . |
| 445806 | 4/1936 | United Kingdom . |
| 478735 | 1/1938 | United Kingdom . |

OTHER PUBLICATIONS

Fort & Lloyd, *The Chemistry of Dyestuffs*, Cambridge 1917, p. 165.

Chemical Abstracts, vol. 33 (1939) p. 9169(3) Abstracting Gaspar German Patent No. 677740.

*Primary Examiner*—Paul R. Michl
*Assistant Examiner*—Patrick A. Doody
*Attorney, Agent, or Firm*—Wenderoth, Lind & Ponack

[57] ABSTRACT

A photographic material for the silver dye bleach process comprises, in at least one layer, a colloidal dispersion of azo in gelatine, the ratio of azo dye to gelatine being 1:1 to 1:10.

16 Claims, 2 Drawing Sheets

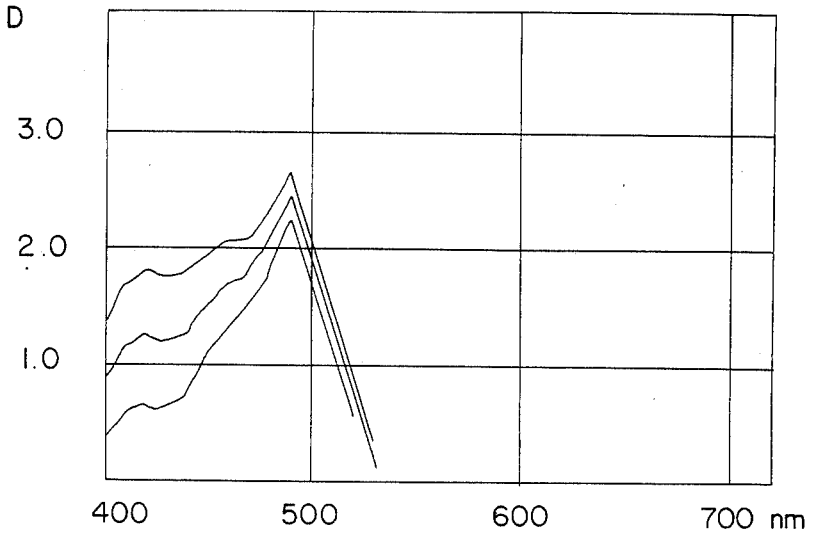
(MATERIAL H)
FIG. 1
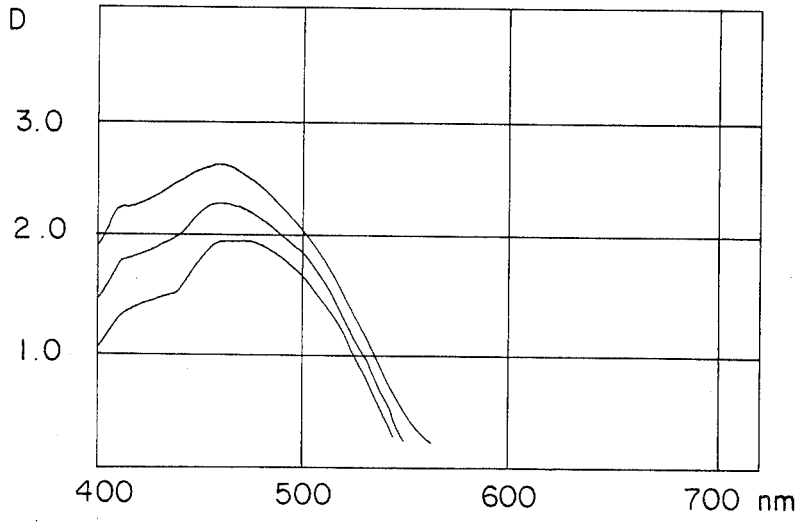
FIG. 2 ( MATERIAL K)

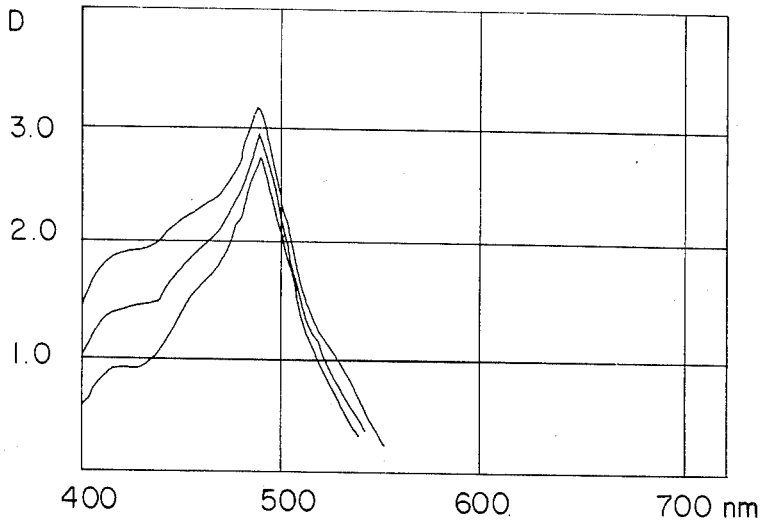
FIG. 3 (MATERIAL J)
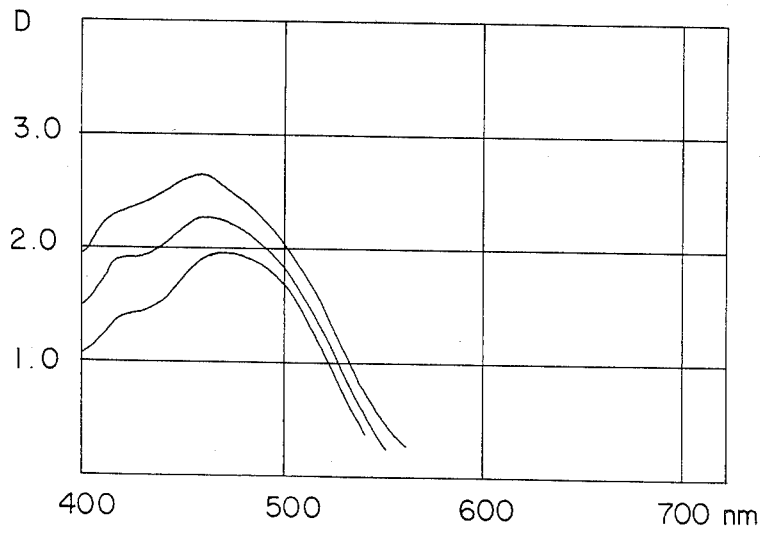
FIG. 4 (MATERIAL L)

PHOTOGRAPHIC MATERIAL FOR THE SILVER DYE BLEACH PROCESS COMPRISING AN AZO DYE, CAPABLE OF LAKING, IN GELATINE

The present invention relates to novel photographic material for the silver dye bleach process.

Photographic materials for the silver dye bleach process must meet evermore stringent requirements. In particular, shorter and shorter processing times are expected.

Shorter processing times require higher temperatures of the processing baths and/or a reduced layer thickness of the photographic material, thinner layers being also desirable for other reasons, since they increase the image sharpness and improve the utilizability of the processing baths.

However, a reduction in layer thickness corresponds to an increase in the dye/gelatine ratio, since the maximum dye density (or dye quantity per unit area) is given by the product. There are, however, limits to the dye/-gelatine ratios which can be reached with the known diffusion-resistant, water soluble image dyes, and when these ratios are exceeded, troublesome changes in the viscosity of the coating solutions can occur and cause considerable problems in coating.

It is therefore the object of the present invention to provide a photographic material for the silver dye bleach process, which contains layers which can be coated virtually without any difficulties and have a higher dye/gelatine ratio than was hitherto normal.

It has now been found that such layers are obtainable by using a colloidal dispersion of water-insoluble salts of water-soluble azeo dyes, capable of laking, in gelatine.

The present invention thus relates to a photographic material for the silver dye bleach process, which comprises, in at least one layer, a colloidal dispersion of water-insoluble salts of water-soluble azo dyes, capable of laking, in gelatine, the colloidal particles having a size of 0.01 to 1 μm and the ratio of azo dye to gelatine being 1:1 to 1:10.

The present invention also relates to a process for preparing the photographic material according to the invention and to the colloidal dispersion used therein.

To prepare the colloidal dispersion used in the material according to the invention, the azo dyes capable of laking are reacted with at least the stoichiometric quantity, preferably 5 to 10% excess, of divalent or trivalent metal salts in the presence of gelatine.

The metal salts used can be of a type such that they do not impair the photographic properties of the material. The preferred salts are those of magnesium, calcium, strontium, barium, zinc, cobalt, nickel, lanthanum, the lanthanides or mixtures of these salts. Magnesium, calcium, barium and lanthanum salts are particularly preferred, barium salts being the most important. These metals are used in the form of water-soluble salts, preferably as the nitrates.

Examples of suitable azo dyes are the known water-soluble azo dyes which can be used as image dyes in silver dye bleach materials and have been described in a large number of patent applications, for example Swiss Pat. Nos. 433,979, 448,740, 440,965, 501,247, 528,753, 489,038, 528,753, 489,038, 512,082, 515,528, 524,834, 567,282, 551,643, 563,600, 572,230, 566,029 and 572,231, U.S. Pat. No. 3,931,142 and European Pat. No. 169,808. However, other azo dyes which are not described in these documents are also suitable for use in the colloidal dispersions according to the invention, provided that these dyes can be laked by the said metal salts and can be bleached in the manner conventional for silver dye bleach materials.

The dyes listed can be represented by the formula which follows

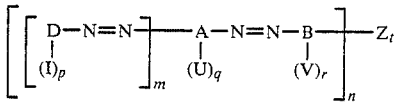

(1)

in which A, B and D independently of one another are phenyl or naphthyl, these radicals being unsubstituted or substituted by hydroxyl, amino, $—NHR_1$ or $—N(R_2)_2$, in which $R_1$ and $R_2$ are alkyl having 1 to 8 carbon atoms, $—C_2H_4OH$, $—COR_3$ with $R_3$ being alkyl having 1 to 10 carbon atoms, phenyl, phenyl substituted by halogen, alkoxy, acylamino, alkylcarbonyl, alkylsulfonyl or halogenoalkyl each having 1 to 4 carbon atoms in the alkyl moiety, or carboxyl,

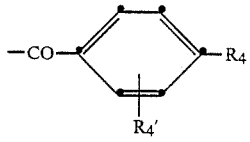

in which $R_4$ and $R_4'$ independently of one another are hydrogen, halogen, nitro, trifluoromethyl, alkyl or alkoxy each having 1 to 4 carbon atoms, —NHCOX, $—NHSO_2Y$, —COZ or $—SO_2Z$, in which X is hydroxyl, $HO_2C$-alkyl, $HO_2C$-alkenyl, $HO_2C$-pheyl, $HO_3S$-phenyl, phenyl, furanyl, thienyl, or pyridyl, Y is alkyl, phenyl, alkylphenyl or $HO_2C$-phenyl and Z is alkyl or amino, or $R_1$ and $R_2$ are

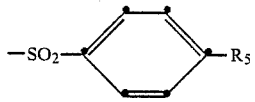

in which $R_5$ is hydrogen, methyl or chlorine, or

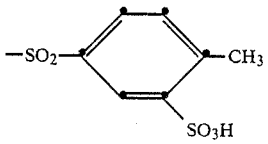

and $R_1$ can also be a radical of the formula

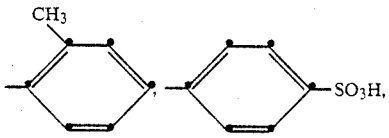

-continued

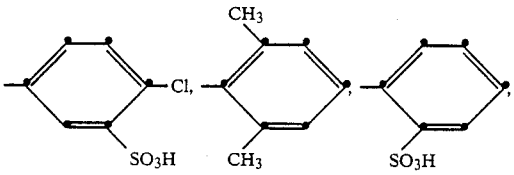

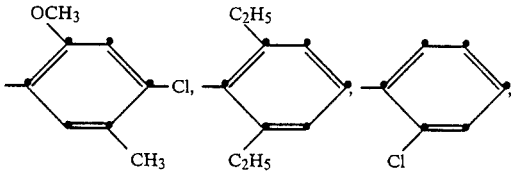

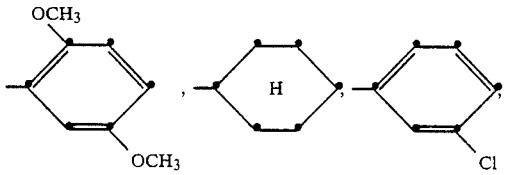

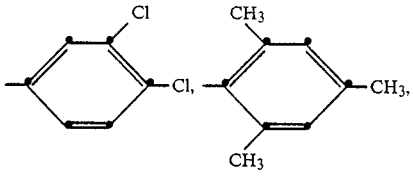

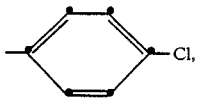

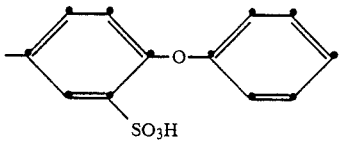

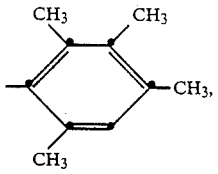

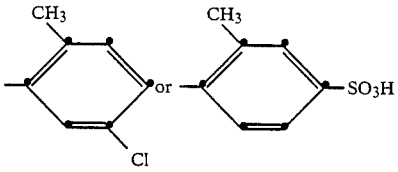

or A, B and D may be substituted independently of one another by $-OCH_3$, $-OC_2H_5$, $-OC_2H_4OH$, $OC_2H_4OC_2H_4OH$, $-SCH_3$, $-SC_2H_5$, $-SO_2CH_3$, $-SO_2C_2H_5$, $-SO_3C_4H_9$ or $-CO_2R_6$ or $-OCOR_6$, in which $R_6$ is alkyl having 1 to 5 carbon atoms or phenyl, I, U and V are $-SO_3M$ or $-CO_2M$, in which M is hydrogen, sodium or potassium, Z is, if n=2, a bridge member linked via an —NH-group to each of the adjoining aromatic radicals B or, if n=1, is a radical of the formula

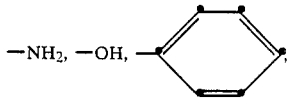

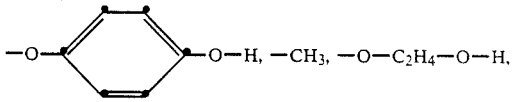

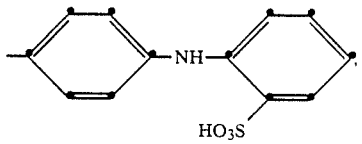

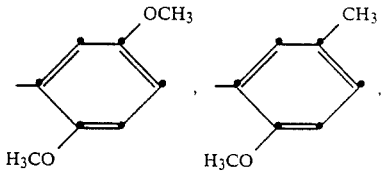

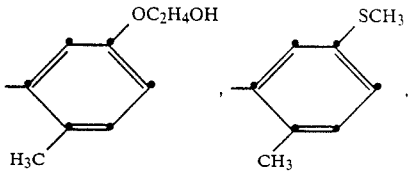

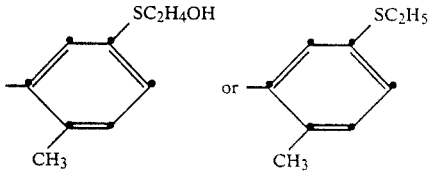

linked directly to B, m is 0, 1 or 2, n is 1 or 2, p, q and r are 0, 1, 2 or 3 and t is 0 or 1.

If t=1 and n=2, Z in the compounds of the formula (1) is a bridge member which mutually links two identical or different dye moieties. Z can be, for example, one of the following divalent radicals of the formula —S—, especially —N=N—,

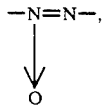

—SO—, $-SO_2-$, —NH—, —O—, $-CH_2-$ and $-O-C_2H_4-O-$, as well as

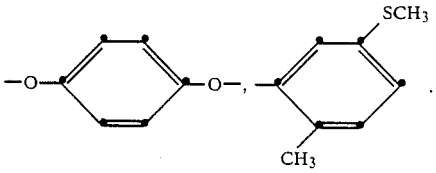

-continued

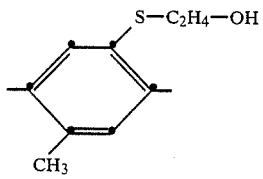

and especially

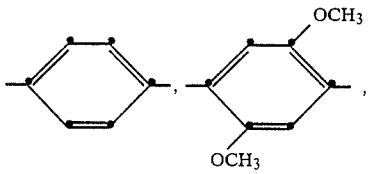

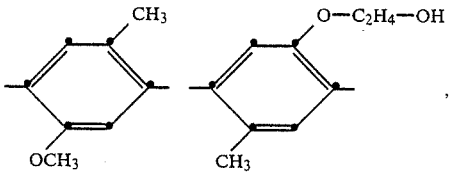

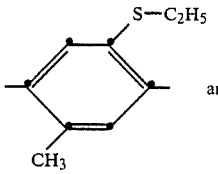

and

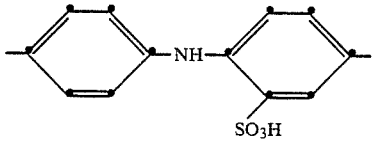

Z can also be linked via an —NH-group to each of the adjoining aromatic groups B and can thus be represented, for example, as the radical of the following acylation components: thiophosgene, pimelic acid dichloride, suberic acid dichloride, azelaic acid dichloride, sebacic acid dichloride, chlorosuccinic acid dichloride, 2,3-dichlorosuccinic acid dichloride, fumaric acid dichloride terephthaloyl chloride, isophthaloyl chloride, 5-nitrosophthaloyl chloride, thiophene-2,5-dicarboxylic acid dichloride, furan-2,5-dicarboxylic acid dichloride, pyridine-2,5-dicarboxylic acid chloride, pyridine-2,6-dicarboxylic acid dichloride, pyridine-3,5-dicarboxylic acid dichloride, azobenzene-3,3'-dicarboxylic acid dichloride, 4,4'-dimethylazobenzene-3,3'-dicarboxylic acid dichloride, 4,4'-dichloroazobenezene-3,3'-dicarboxylic acid dichloride, azobenzene-4,4'-dicarboxylic acid dichloride, 2,2'-dimethoxyazobenzene-5,5'-dicarboxylic acid dichloride, pyrrole-2,5-azobenzene-5,5'-dicarboxylic acid dichloride, 2,2'-dichloroazobenzene-5,5'-dicarboxylic acid dichloride, 2,2'-dimethylazobenzene-4,4'-dicarboxylic acid dichloride, 3,3'-dichloroazobenzene-4,4'-dicarboxylic acid dichloride, azobenzene-4,4'-disulfonic acid dichloride, azobenzene-3,3'-disulfonic acid dichloride, diphenyl-1,1'-sulfone-4,4'-dicarboxylic acid dichloride, benzene-1,3-disulfonic acid chloride, diphenylmethane-3,3'-dicarboxylic acid dichloride, diphenylmethane-4,4'-dicarboxylic acid dichloride, diphenyl sulfide-4,4'-dicarboxylic acid dichloride, diphenyl disulfide-2,2'-dicarboxylic acid dichloride, diphenyl disulfide-4,4'-dicarboxylic acid, dichloride, cyanuric chloride, methoxycyanuric chloride, 1-phenyl-3,5-dichloro-s-triazine, 1-methoxy-3,5-dichloro-s-triazine and especially phosgene, oxalyl chloride, malonic acid dichloride, succinic acid dichloride, glutaric acid dichloride, adipic acid dichloride, 2,2'-dimethylazobenzene-5,5'-dicarboxylic acid dichloride, 4,4'-dichloroazobenzene-5,5'-dicarboxylic acid dichloride and also the compounds of the formulae

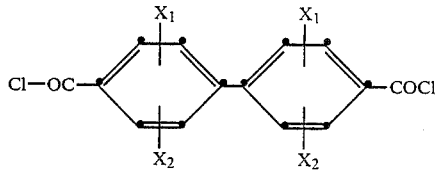

and

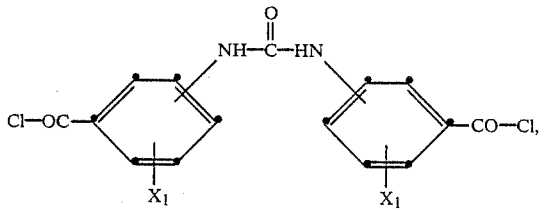

in which $X_1$ and $X_2$ are hydrogen or methoxy, and also

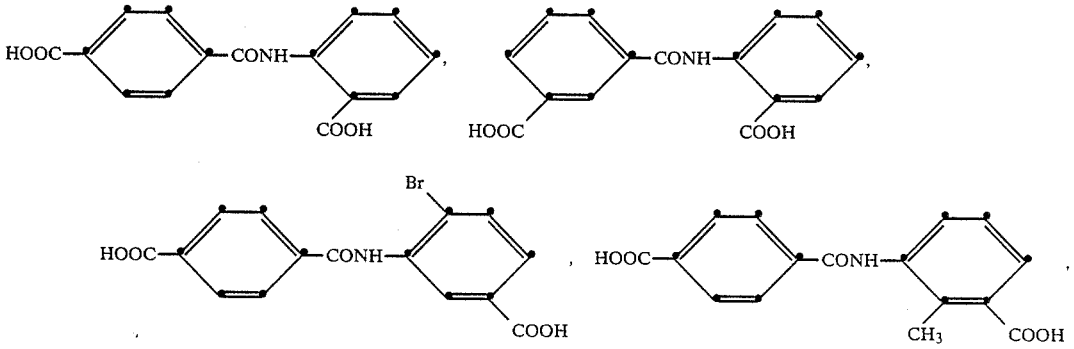

-continued
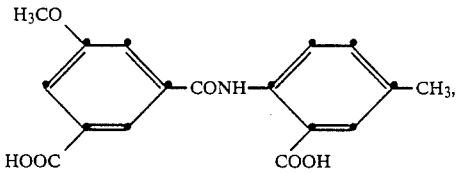
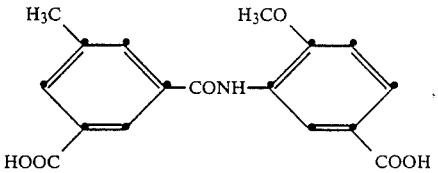
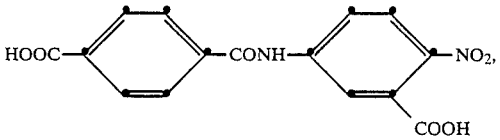
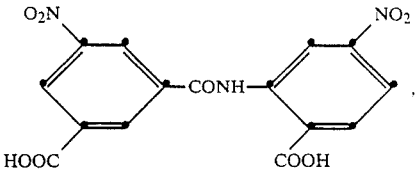
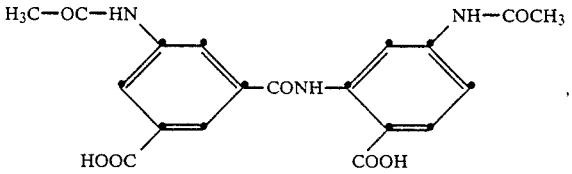
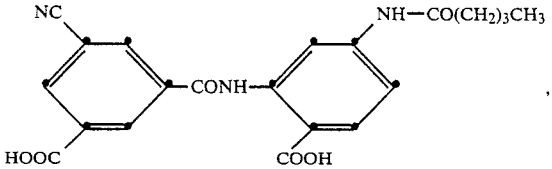
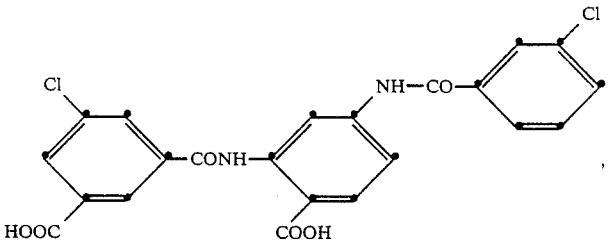
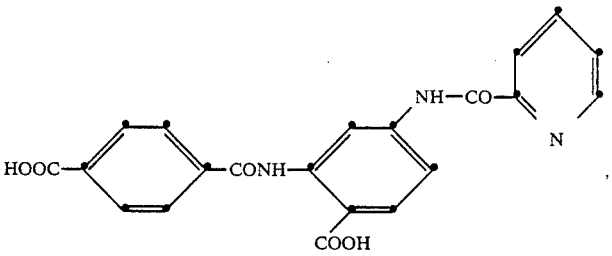
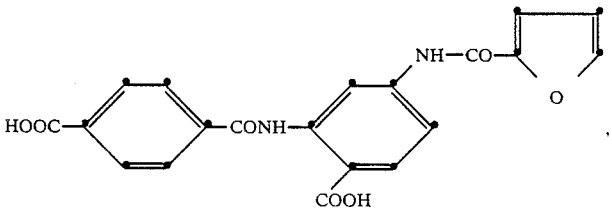

-continued
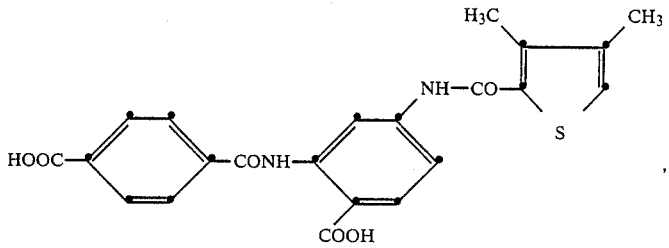
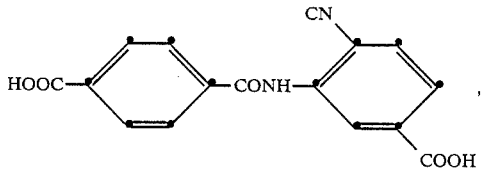
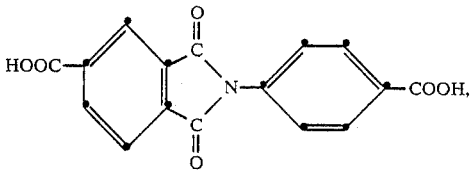
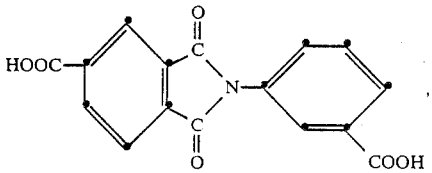
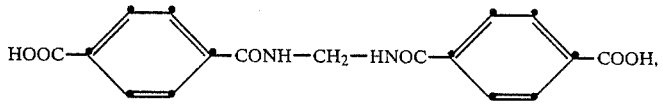
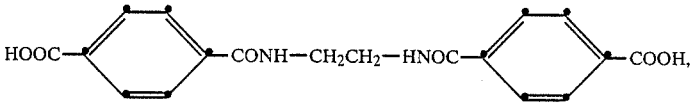
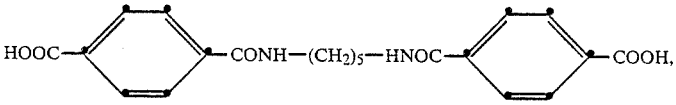
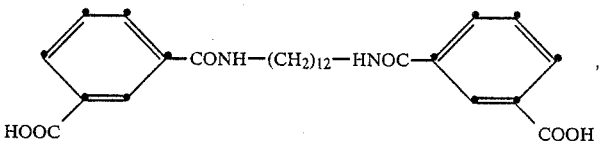
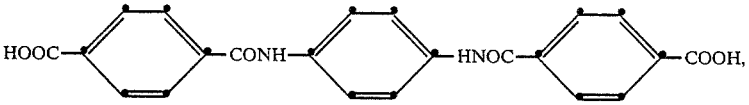
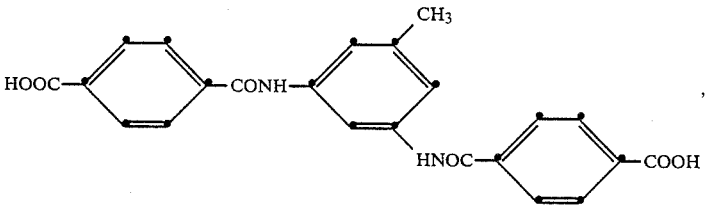
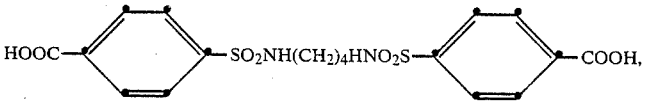

-continued
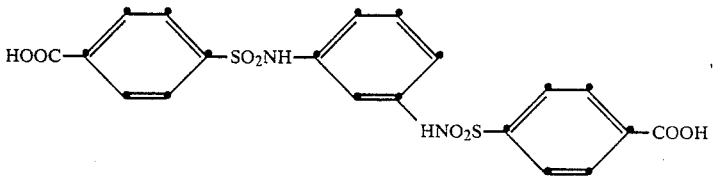
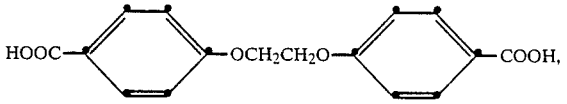
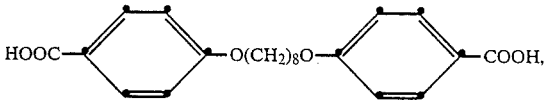
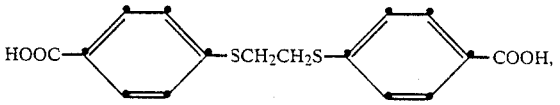
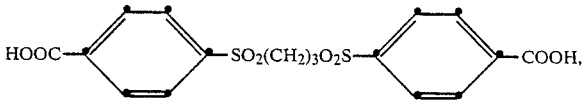
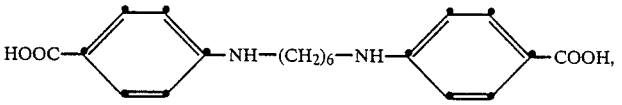
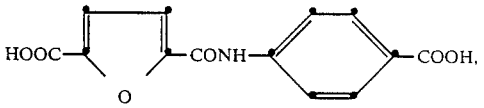
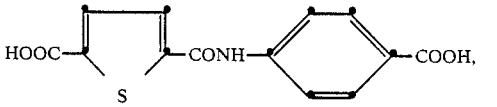
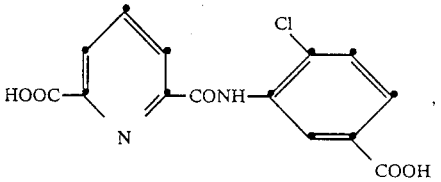
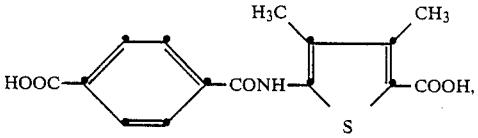
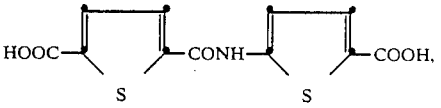
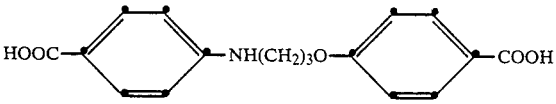
and especially
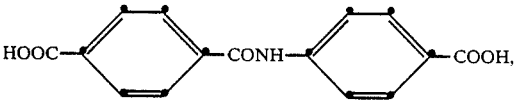
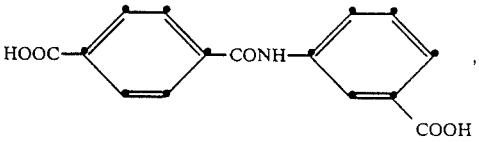
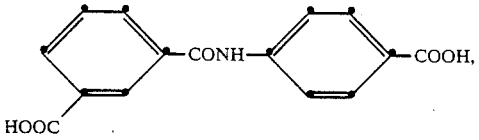
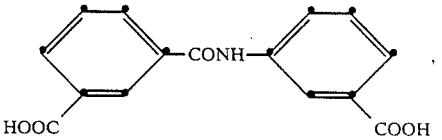

-continued

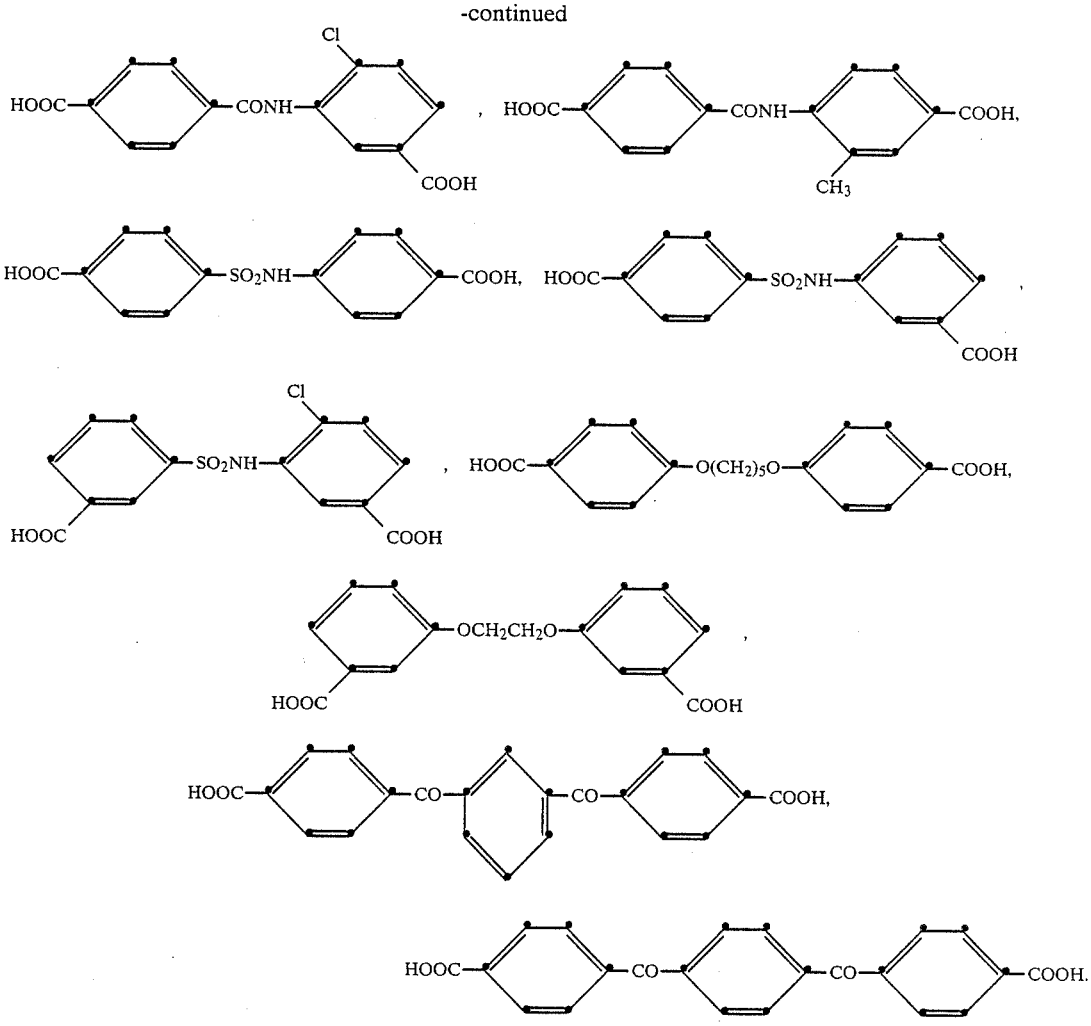

Preferred azo dyes of the formula (1) contain at least 2 and especially at least 3 sulfo groups.

A particularly suitable group of azo dyes of the formula (1) is that of the formula

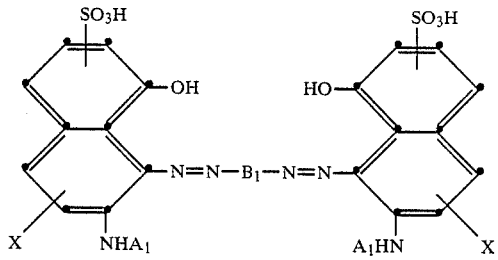

(2)

in which $A_1$ is hydrogen, methyl, hydroxyethyl, phenyl, or phenyl which is substituted by alkyl, haloenoalkyl or alkoxy each having 1 to 4 carbon atoms, halogen, sulfo or carboxyl, alkylsulfonyl or alkylcarbonyl each having 1 to 4 carbon atoms in the alkyl moiety, X is hydrogen or sulfo, $B_1$ is a radical of the formula $—D_1—NH—M_1—HN—D_1—$, in which $D_1$ is sulfonated phenylene or naphthylene and $M_1$ is a radical of the formula $—OC—E_1—Z—E_1'—CO—$, in which Z is —CONH—, $—SO_2NH$, $—CONH(CH_2)_nHNOC—$, $—CONH—C_6H_4—HNOC$, $—SO_2NH(CH_2)_nHNO_2S—$, $—SO_2N—H—C_6H_4—HNSO_2$, —CO—NH—OC—, $—CO\text{-}(C_6H_4—OC)\text{-}_m$,

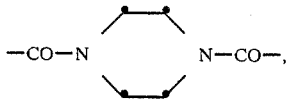

$—O\text{-}(CH_2)\text{-}_nO—$, $—S—(CH_2)_n—S—$, $—SO_2(CH_2)_nO_2S—$, $—NR—(CH_2)_n—NR—$ or $—NHCO(CH_2)_nO—$, in which R is alkyl having 1 to 4 carbon atoms, m is an integer from 1 to 5 and n is an integer from 1 to 12, and $e_1$ and $E_1'$ are phenyl, furanyl, thiophenyl or pyridyl, or phenyl which is substituted by halogen, alkyl or alkoxy having 1 to 4 carbon atoms, nitro, acylamino or cyano.

Moreoever, those azo dyes of the formula (1) are preferred which are of the formula (3)

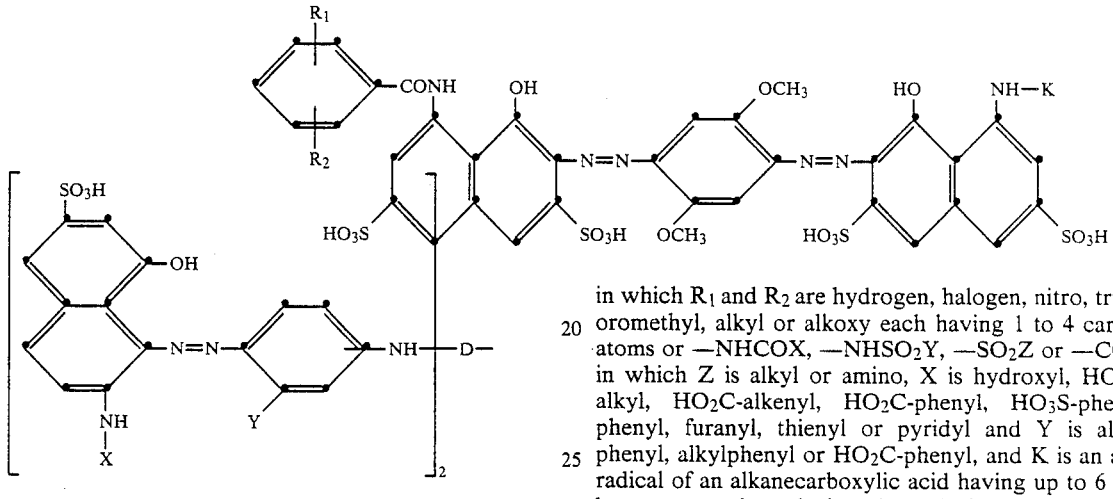

in which X is hydrogen, phenyl, or phenyl which is substituted by alkyl or alkoxy each having 1 to 4 carbon atoms, halogen, sulfo, alkylsulfonyl or alkylcarbonyl each having 1 to 4 carbon atoms in the alkyl moiety, D is a carbonyl radical or a heterocyclic or carbocyclic aromatic dicarbonyl radical and Y is $—CF_3$, —CN, $—SO_2T$ or $—SO_2NR_3R_4$, in which T is methyl, phenyl or 4-methyl-3-sulfopheyl, $R_3$ is hydrogen, alkyl, alkyl which is substituted by hydroxyl, alkoxy having 1 to 4 carbon atoms or sulfo, phenyl, or phenyl which is substituted by sulfo, carboxyl, alkyl or alkoxy each having 1 to 4 carbon atoms or by halogen, $R_4$ is hydrogen or hydroxyalkyl having 1 to 4 carbon atoms, or $R_3$ and $R_4$ are alkylene having 4 or 5 carbon atoms or a radical of the formula $—(CH_2)_2—Z—(CH_2)_2—$, in which Z is —O—, —NH— or $—NCH_3—$.

Preferred azo dyes of the formula (1) are also those of the formula (4)

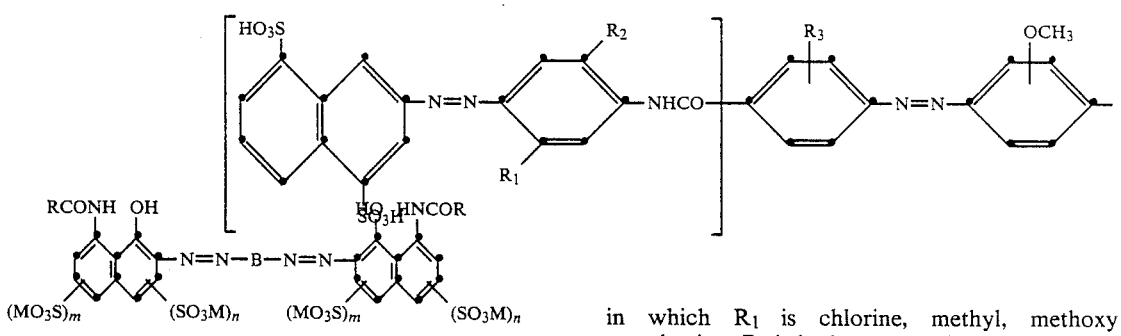

in which R is alkyl having 1 to 10 carbon atoms, phenyl, or phenyl which is substituted by halogen, in particular chlorine, alkoxy having 1 to 4 carbon atoms, acylamino, especially acetamino, halogenoalkyl having 1 to 4 carbon atoms, in particular trifluoromethyl, or alkylsulfonyl, in particular methylsulfonyl, B is as defined for $B_1$ in formula (3), M is hydrogen, an alkali metal or ammonium, and m and n independently of one another are 0 or 1.

Amongst the azo dyes of the formula (1), those of the formula (5)

in which $R_1$ and $R_2$ are hydrogen, halogen, nitro, trifluoromethyl, alkyl or alkoxy each having 1 to 4 carbon atoms or —NHCOX, $—NHSO_2Y$, $—SO_2Z$ or —COZ, in which Z is alkyl or amino, X is hydroxyl, $HO_2C$-alkyl, $HO_2C$-alkenyl, $HO_2C$-phenyl, $HO_3S$-phenyl, phenyl, furanyl, thienyl or pyridyl and Y is alkyl, phenyl, alkylphenyl or $HO_2C$-phenyl, and K is an acyl radical of an alkanecarboxylic acid having up to 6 carbon atoms, and unsubstituted or substituted benzenecarboxylic or pyridinecarboxylic acid or benzenesulfonic acid, are also suitable for use in the photographic material according to the invention, as are also those of the formulae (6)

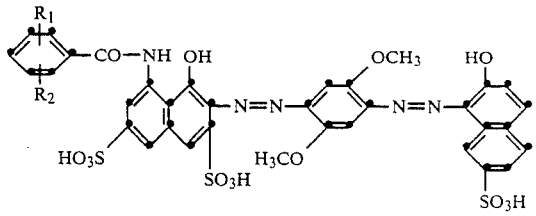

in which $R_1$ and $R_2$ are hydrogen, methoxy, halogen, methyl, trifluoromethyl, nitro, X—CONH—, Y—$SO_2NH$— or Z—$SO_2$—, X being hydroxyl, $HO_2C$-alkyl, $HO_2C$-alkenyl, phenyl, $HO_2C$-phenyl, $HO_3S$-phenyl, furyl, thienyl or pyridyl, Y being alkyl, phenyl, alkylphenyl or $HO_2C$-phenyl and Z being alkyl or amino, and (7)

in which $R_1$ is chlorine, methyl, methoxy or acetylamino, $R_2$ is hydrogen, methyl, methoxy, ethoxy or hydroxyethoxy and $R_3$ is hydrogen or methoxy.

The reaction of the azo dyes of the formula (1) with the abovementioned metal salts is preferably carried out at a temperature from 30 to 60, in particular from 40° to 50° C.

During the reaction, the pH should, on the one hand, not fall below the isoelectric point of the gelatine used but, on the other hand, should also not move into the strongly alkaline range. Advantageous pH values are thus in the range from 5 to 8, preferably 6 to 7.

In the preparation of the colloidal dispersions, the important point is that the precipitation of the azo dyes with the metal salts is carried out in the presence of the gelatine. The order in which aqueous solutions of azo dye and metal salt are added to the aqueous gelatine solution can then be freely selected. As a rule, such a quantity of gelatine is first introduced that its concentration in the finished dispersion is 1 to 8% and preferably 2 to 6%.

Skin and ossein gelatines of medium viscosity, which preferably have been deionized, are especially suitable for the preparation of the dispersions. A low electrolyte content is desirable in order not to impair the stability of the dispersions.

It is of advantage when the reaction mixture is stirred during the reaction. Conventional stirring methods have proved adequate. In certain cases, however, subsequent treatment of the dispersion, for example in a high-pressure homogenizer or ultrasonically, can be advantageous.

The colloidal dispersions which have been prepared in this way and which as a rule contain rod-shaped particles of a length of 0.01 to 1 μm show, as compared with gelatine solutions of corresponding sodium and potassium salts of the same concentration, a higher stability particularly towards flocculations of the dye salts.

Layers in photographic silver dye bleach materials, which contain these colloidal dispersions, can be bleached with the same ease as corresponding conventional layers, and in the preparation of which aqueous azo dye solutions are used. They have a homogeneous dye distribution and do not show any microscopically visible dye particles.

Further photograhic advantages resulting from the use of the colloidal dispersions, for example a comparatively higher sensitivity, a lower decrease in sensitivity during storage life and improved sensitisation, are demonstrated in the examples which follow below. In Example 22, it is also shown that, in the material according to the invention, diffusion of the image dyes into adjoining layers can be virtually completely suppressed if, for further reducing the solubility of the dye dispersions, the appropriate metal salts are additionally incorporated in quantities of 0 to 50 mg/m$^2$ into interlayers or protective layers.

In a preferred embodiment of the present invention, the material according to the invention contains at least one layer with a colloidal dispersion in gelatine of water-insoluble calcium, barium or lanthanum salts of azo dyes of the formula (1), in which A, B and D independently of one another are phenyl or naphthyl which is unsubstituted or substituted by hydroxyl, amino or —NHR$_1$, in which R$_1$ is

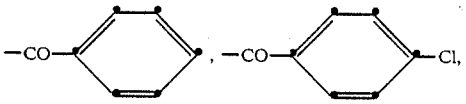

-continued

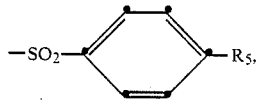

in which R$_5$ is hydrogen, methyl or chlorine,

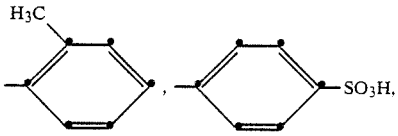

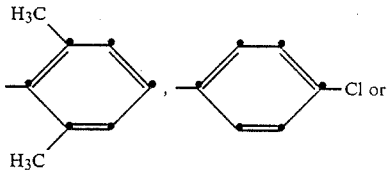

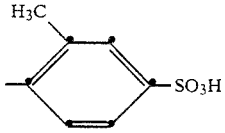

or A, B and D may be substituted by —OCH$_3$, —OC$_2$H$_5$, —OC$_2$H$_4$O —SC$_2$H$_5$, —SO$_2$CH$_3$, —SO$_2$C$_2$H$_5$, —SO$_3$C$_4$H$_9$ or —CO$_2$R$_6$ or —OCOR$_6$ in which R$_6$ is alkyl having 1 to 5 carbon atoms or phenyl, Y, U and V are —SO$_3$M, in which M is hydrogen, sodium or potassium, Z is, if n=2, a bridge member linked via an —NH-group to each of the adjoining aromatic radicals B or, if n=1, is a radical of the formula

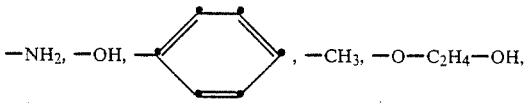

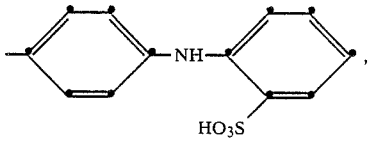

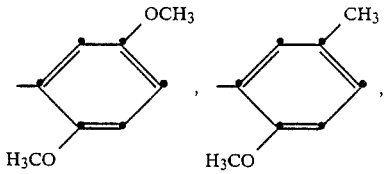

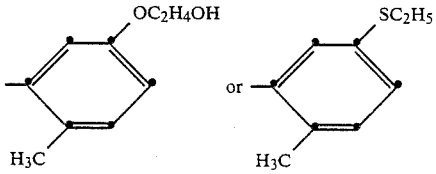

linked directly to B, and m, n, p, q, r and t are as defined above, the colloid particles having a size of 0.01 to 0.5

μm and the ratio of azo dye to gelatine being 1:2 to 1:10, especially 1:2 to 1:6.

If necessary, the colloidal dispersions used according to the invention can be provided with further components which are conventionally used for building up photographic layers, for example silver halide emulsions, sensitizers, filter dyes, hardeners and the like, the stability of the dispersions being retained. Coating solutons obtained in this way show a viscosity and dring behaviour which are very advantageous for the coating process, so that corresponding photographic layers can be prepared without any problems.

For the silver dye bleach materials according to the invention, those conventional silver halide emulsions are suitable which are described, for example, in Research Disclosure No. 17,643, December 1978, Research Disclosure No. 22,534, January 1983, and British Pat. Nos. 1,507,989, 1,520,976, 1,596,602 and 1,570,581 and in German Pat. Nos. 3,241,634, 3,241,638, 3,241,641, 3,241,643, 3,241,645 and 3,241,647. The chemical and spectral sensitization of these emulsions is likewise carried out by methods known per se, for example in accordance with Research Disclosure No. 17,643, Sections IIIA and IV, or in accordance with Research Disclosure No. 22,534, pages 24 to 28.

The binders or disperants for the silver halides and image dyes to be used are the conventional colloids, for example gelatine or gelatine derivatives, if appropriate in combination with other colloids. Suitable binders or dispersants are described, for example, in Research Disclosure No. 17,643, Section IX.

Section X of this literature reference has also disclosed compounds which can be used as hardeners for the silver halide emulsions.

A large number of further additives can be added to the silver halide emulsions, for example anti-fogging agents, stabilizers and agents for reducing the pressure sensitivity. These and further additives are known and have been described, for example, in C. E. K. Mees, The Theory of the Photographic Process, 2nd edition, Macmillan, 1985, page 677 to 680, and in Research Disclosure No. 17,643, Sections V–VIII, XI–XIV, XVI, XX and XXI.

In the preparation of the materials according to the invention, the most diverse conventional layer basis, for example, polymeric films, papers, metal foils, glass carriers and carriers of ceramic materials, such as are known from Research Disclosure No. 17,643, Section VII, can be used.

For processing the material according to the invention, thus exposed, the known processes are used which comprise the conventional process stages such as silver development, dye bleach, silver bleach and fixing as well as one or more water washings. If appropriate, the silver bleach can be combined with the dye bleach and/or fixing into a single processing stage. Suitable processing methods are described in detail, for example, in German Pat. Nos. 1,924,723, 2,258,076, 2,423,814, 2,448,433, 2,547,720 and 2,651,969.

The examples which follow illustrate the invention without limiting it thereto.

The percentages given are percent by weight.

Examples 1 to 10 relate to the preparation of dye dispersions according to the invention and to their characterization.

EXAMPLE 1

4.79 g of a deionized bone gelatine of medium viscosity are allowed to swell for 30 minutes at 20° C. together with 80.4 g of water and 7.32 ml of a 0.1 molar aqueous solution of lanthanum nitrate. The mixture is then warmed to 50° C. and stirred for 20 minutes until the gelatine has dissolved. 60.05 g of a 1.103% aqueous solution of the dye of the formula (100)

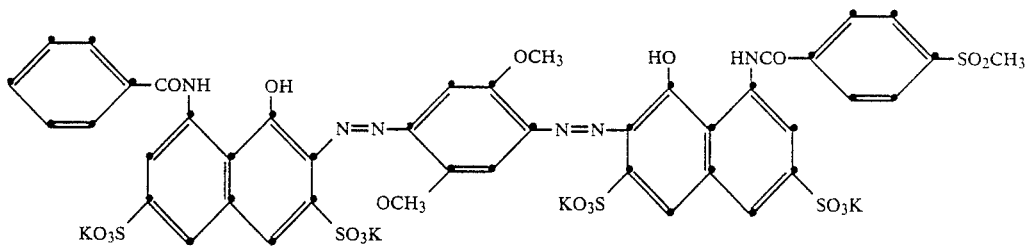

are then added with good stirring (temperature 50° C.). After 15 minutes, 16.05 g of a 10% gelatine solution and 28.21 g of water are added, and stirring is continued for 10 minutes at 50° C. After ionic etching or negative contrasting, rod-shaped dye salt particles of about 120 nm mean length and 12 nm mean diameter can then be identified in the electronmicroscope, but no particles are visible in an optical microscope.

The ATR spectrum [Attenuated Total Reflection, described in Internal Reflection Spectroscopy, by N. J. Harrick, 1967, John Wiley & Sons, Inc.] shows an absorption maximum at 617 nm which corresponds to a highly aggregated state of the lanthanum salt of the dye of the formula (100), and a subsidiary maximum at 766 nm which is to be assigned to the monomer of the dye of the formula (100).

For comparison, a solution of the dye of the formula (100) in gelatine is prepared, the lanthanum nitrate solution being replaced by water but the procedure followed being in other respects the same as indicated above. In contrast to the colloidal dispersion of the lanthanum salt, the ATR spectrum of this solution shows a much lower aggregated state of the dye of the formula (100), which is characterized by the absence of the aggregate band at 617 nm and a higher proportion of monomer (760 nm absorption maximum). No colloidal dye particles are identifiable in the electronmicroscope after ionic etching or negative contrasting.

EXAMPLE 2

A colloidal dispersion of the calcium salt of the dye of the formula (100) is prepared. For this purpose, the procedure of Example 1 is followed, but the lanthanum nitrate solution is replaced by 11.0 ml of a 0.1M calcium nitrate solution. Colloidal particles of a mean length of 300 nm and a mean diameter of 13 nm are formed. The ATR spectrum of the calcium dispersion shows a similarly high state of aggregation as the corresponding spectrum from Example 1.

EXAMPLE 3

A colloidal dispersion of the zinc salt of the dye of the formula (100) is prepared as described in Example 1, the lanthanum nitrate solution being replaced by 11 ml of a 0.1M solution of zinc nitrate. Particles of a mean length of 33 nm and a mean diameter of 8 nm are formed. The dispersion can be stored for many weeks in a refrigerator, without the particle size changing. In the same way, a colloidal dispersion of the barium salt is obtained if the zinc nitrate solution is replaced by the same quantity of a 0.1M barium nitrate solution. The particles have a mean length of 200 nm and a mean diameter of 10 nm.

EXAMPLE 4

4.8 g of a deionized gelatine of medium viscosity are allowed to swell for 30 minutes at 20° C. together with 77 g of water in 60 g of a 1.103% aqueous solution of the dye of the formula (100). The mixture is then warmed to 50° C. and stirred for 20 minutes until the gelatine has dissolved. With continuous stirring, 10.44 ml of a 0.1M cobalt nitrate solution warmed to 50° C. are then added and the mixture is stirred for a further 15 minutes at 50° C. This gives a colloidal dispersion of the cobalt salt of the dye of the formula (100). No particles are visible in an optical microscope, and the ATR spectrum indicates a highly aggregated state of the dye.

EXAMPLE 5

44 g of a deionized bone gelatine of medium viscosity are first allowed to swell for 30 minutes at 20° C. in 1000 g of a 1.1% aqueous solution of the dye of the formula (100). The mixture is then warmed to 50° C. and stirred for 20 minutes until the gelatine has dissolved. The gelatine/dye solution is cooled to 40° C. and 44.6 g of a 10% aqueous solution of $Mg(NO_3)_2.6H_2O$ are added within 8 minutes with intensive stirring. Stirring is continued for 5 minutes at 40° C., and the dispersion is then treated ultrasonically for 6 minutes. The resulting dye salt particles have a mean length of 700 nm and a mean thickness of 30 nm.

EXAMPLE 6

4.10 g of a deionized bone gelatine of medium viscosity are allowed to swell for 30 minutes at 20° C. together with 36 g of water and 6.25 ml of a 0.1M solution of lanthanum nitrate. The mixture is then warmed to 50° C. and stirred for 20 minutes until the gelatine has dissolved. 59.55 g of a 0.921% aqueous solution of the dye of the formula

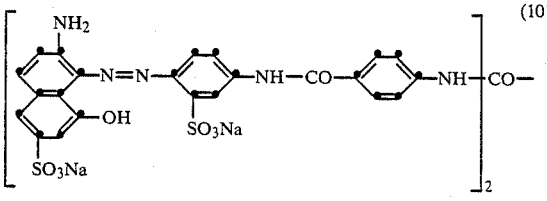

(101)

are then added with stirring and the mixture is stirred for 15 minutes at 50° C. 25.5 g of water and 15.9 g of a 10% gelatine solution are then added and stirring is continued for 10 minutes at 50° C.

In the electron microscope, colloidal, rod-shaped dye salt particles of a mean length of 117 nm and a mean diameter of 12 nm are found.

The ATR spectrum shows an absorption maximum at 570 nm, which corresponds to a highly aggregated state of the dye of the formula (101).

For comparison, a solution of the sodium salt of the dye of the formula (101) is prepared by replacing the lanthanum nitrate solution by water but, in other respects, following the same procedure as described above. The ATR spectrum of this solution shows an absorption maximum at 508 nm (monomeric state) and only a weak shoulder at about 550 nm which corresponds to a more highly aggregated state.

No colloidal dye particles are detectable in the electron microscope.

The colloidal dispersion of the calcium salt of the dye of the formula (101) is prepared. For this purpose, the procedure indicated in Example 5 is followed, but the lanthanum nitrate solution is replaced by 9.4 ml of a 0.1M calcium nitrate solution. Colloidal dye particles of a mean length of 170 nm and a mean diameter of 20 nm are formed. The ATR spectrum shows a state which is as highly aggregated as in the case of the lanthanum salt.

EXAMPLE 8

A colloidal dispersion of the barium salt of the dye of the formula (101) is prepared as described in Example 5, the lanthanum nitrate solution being replaced by 9.4 ml of a 0.1M solution of barium nitrate. Colloidal dye particles similar to those described in Example 7 are formed.

Colloidal dispersion of the zinc salt can be obtained in the same way if the barium nitrate solution is replaced by the same quantity of a 0.1M zinc nitrate solution.

EXAMPLE 9

4.1 g of a deionized gelatine of medium viscosity are allowed to swell for 30 minutes at 20° C. together with 33 g of water and 60 g of a 0.921% solution of the dye of the formula (101). The mixture is then warmed to 50° C. and stirred for 20 minutes until the gelatine has dissolved. With further stirring, 8.99 ml of a 0.1M cobalt nitrate solution warmed to 50° C. are then added and the mixture is stirred for a further 15 minutes at 50° C. This gives a colloidal dispersion of the cobalt salt of the dye of the formula (101).

EXAMPLE 10

55.1 g of a deionized gelatine of medium viscosity are allowed to swell for 30 minutes at 20° C. in 1000 g of a 1.1% aqueous solution of the dye of the formula (101). The mixture is then warmed to 50° C. and stirred for 20 minutes until the gelatine has dissolved. After cooling to 40° C., 46 g of 10% aqueous solution of $Mg(NO_3)_2 \cdot 6H_2O$ are added within 8 minutes with intensive stirring. Stirring is continued for 5 minutes at 40° C. and the dispersion is then treated ultrasonically for 6 minutes. The resulting dye salt particles have a mean length of 100 nm and a mean thickness of 3 nm.

EXAMPLE 11

5.4 g of deionized gelatine of medium viscosity, 83.7 g of water and 6.6 ml of 0.1M lanthanum nitrate solution are allowed to swell for 30 minutes at 20° C. The mixture is then warmed to 50° C. and stirred for 20 minutes until the gelatine has dissolved. 72 g of a 0.861% solution of the dye of the formula (102) are added with good stirring, and stirring is continued for 15 minutes. A further 33.6 g of a 10% gelatine solution and 46.5 ml of water are then added. This gives a colloidal dispersion of the lanthanum salt of the dye of the formula

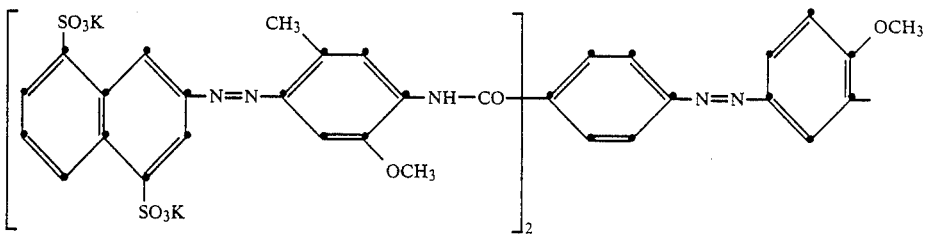

(102)

Particles of a mean length of 150 nm and a mean diameter of 10 nm are visible in the electronmicroscope.

ATR spectra show an absorption maximum at 436 nm with a weak shoulder at about 460 nm. The absorption maximum of 436 nm corresponds to a highly aggregated state of the dye of the formula (102).

For comparison, a solution of the potassium salt of the dye of the formula (102) is prepared, replacing the lanthanum nitrate solution by the same quantity of water but, in other respects, following the same procedure as indicated above. ATR spectra show an absorption maximum at 420 nm, which indicates a lower association of the dye molecules.

A colloidal dispersion of the calcium salt of the dye of the formula (102) is prepared. For this purpose, the procedure of Example 11 is followed, but replacing the lanthanum nitrate solution by 9.9 ml of a 0.1M calcium nitrate solution. Colloidal dye particles are formed which show the same spectrum as the lanthanum salt.

The same results are obtained when the same volume of a 0.1M barium or zinc nitrate solution is used in place of the calcium nitrate solution.

EXAMPLE 13

5.39 g of gelatine are allowed to swell for 30 minutes at 20° C. with 80 g of water and 72 g of a 0.861% solution of the dye of the formula (102). The mixture is then warmed to 50° C. and stirred for 20 minutes until the gelatine has dissolved. With further stirring, 9.39 ml of a 0.1M cobalt nitrate solution warmed to 50° C. are then added and the mixture is stirred for a further 15 minutes at 50° C. This gives a colloidal dispersion of the cobalt salt of the dye of the formula (102). No dye particles are detectable in an optical microscope, and the ATR spectrum indicates a highly aggregated state of the dye.

EXAMPLE 14

58.7 mg of the dye of the formula

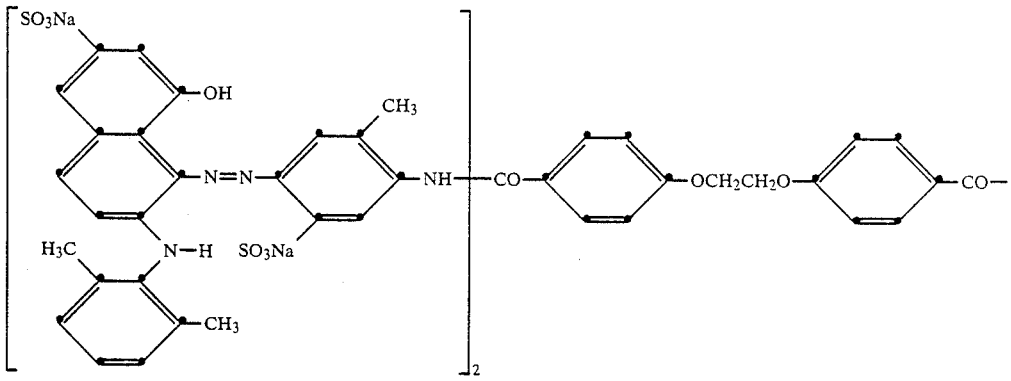

(103)

are dissolved in 10 ml of water. 0.48 g of gelatine are added to this solution which is allowed to swell for 30 minutes at 20° C. The mixture is then warmed to 40° C. and stirred for 30 minutes until the gelatine has dissolved. 0.56 ml of a 0.1M lanthanum nitrate solution are slowly added with stirring to this solution. Stirring is continued for 15 minutes at 40° C., and the pH is then adjusted to 6.8. This gives a colloidal dispersion of the lanthanum salt of the dye of the formula (103) in a highly aggregated state. No particles are visible in an optical microscope.

Colloidal dispersions of similarly high aggregation are obtained if, in place of the dye of the formula (103), 51.4 mg of the dye of the formula (105)

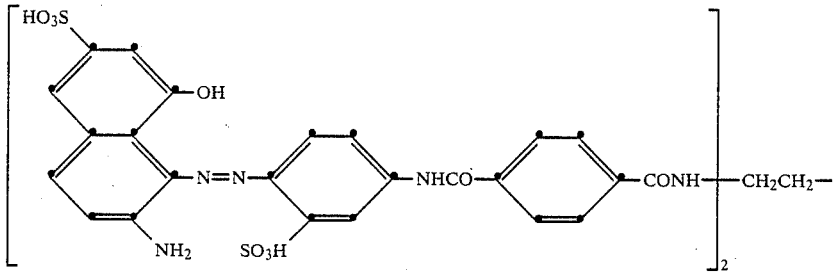

53.2 mg of the dye of the formula (106)

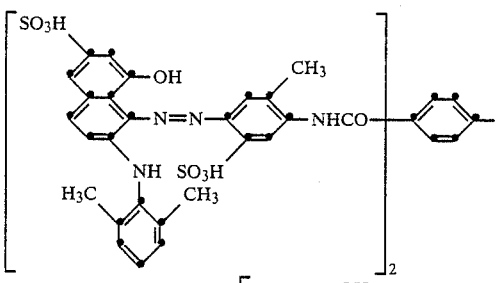

62.1 mg of the dye of the formula (108)

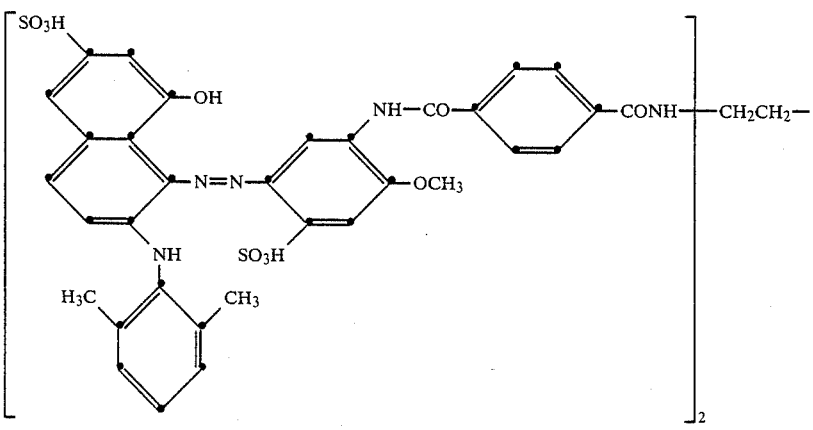

or 64.4 mg of the dye of the formula (108)

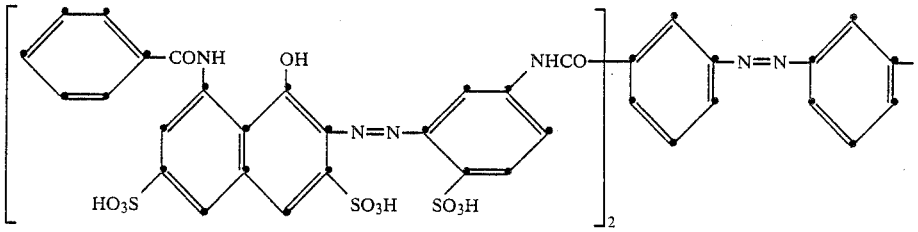

and in each case 0.84 ml of 0.1M lanthanum nitrate solution are used.

EXAMPLE 15

5.56 g of gelatine are allowed to swell for 30 minutes in 54 ml of water. The mixture is then warmed to 50° C., 0.54 ml of 1M calcium nitrate solution is added and the whole is stirred for 20 minutes at 50° C. With further stirring, 40 ml of a 0.94% solution of the dye of the formula (104)

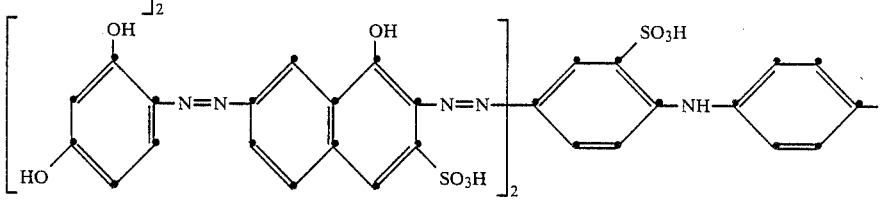

are then added within 15 minutes. This gives a colloidal dispersion of the calcium salt of the dye of the formula (104) in a highly aggregated state, the optical microscope showing no precipitation whatsoever.

EXAMPLE 16

110.5 g of gelatine are allowed to swell for 30 minutes at 20° C. together with 197.8 g of water and 5000 g of a 1.103% solution of the dye of the formula (100). The mixture is then warmed to 50° C. and stirred for 20 minutes until the gelatine has dissolved. 205 g of a 10% calcium nitrate solution warmed to 50° C. are then added and stirring is continued for 15 minutes at 50° C.

The mixture is then homogenized for 1 hour at $3.10^7$ Pa in a high-pressure homogenizer, the temperature being maintained at 40° C. This gives rod-shape colloidal dye particles of a mean length of 300 nm and a mean thickness of 20 nm. The dispersion is free of precipitations of a size greater than 0.5 μm.

A corresponding procedure can be followed with the dyes of the formulae (101) and (102). The colloidal particles of the dye of the formula (101) have a mean length of 150 nm and a mean thickness of 10 nm, the particles of the dye of the formula (102) have a mean length of 300 nm and a mean thickness of 10 nm.

EXAMPLE 17

Three photographic cyan layers a, b and c for the silver dye bleach process are prepared, which each contain, on a transparent polyester base, 2 $g.m^{-2}$ of gelatine, 0.4 $g.m^{-2}$ of silver as a red-sensitized silver bromoiodide emulsion and 0.215 $g.m^{-2}$ of the cyan dye of the formula (100) and, on top, a protective gelatine layer which contains 1.0 $g.m^{-2}$ of gelatine and 0.08 $g.m^{-2}$ of 2,4-dichloro-6-hydroxytriazine (potassium salt) as a gelatine hardener.

Layer a (comparison) contains the dye as the potassium salt, and the coating solution for this case is prepared in the conventional manner by adding the aqueous dye solution to the red-sensitized gelatine/silver halide emulsion.

Layer b contains the dye in the form of a colloidal dispersion of the lanthanum salt, as described in Example 1.

Layer c contains the dye in the form of colloidal dispersion of the calcium salt, as described in Example 2.

The three materials are exposed in the conventional manner behind a stepwedge and processed as follows:

Development 1.5 minutes
Washing 0.5 minutes
Silver and dye bleach 1.5 minutes
Washing 0.5 minutes
Fixing 1.5 minutes
Washing 3.0 minutes
Drying The temperature of each of the baths used is 30° C.

The developing bath contains the following components per liter of solution:

Sodium sulfite 38.0 g
Potassium sulfite 19.9 g
Lithium sulfite 0.6 g
1-Phenyl-3-pyrazolidinone 1.0 g
Hydroquinone 12.0 g
Potassium carbonate 29.1 g
Potassium bromide 1.5 g
Benzotriazole 0.5 g
Sodium ethylenediaminetetraacetate 4.0 g The dye bleach bath has the following composition per liter of solution:

Concentrated sulfuric acid 56.3 g
Sodium m-nitrobenzenesulfonate 6.0 g
Potassium iodide 8.0 g
Hydroxyethylpyridinium chloride 2.4 g
2,3-Dimethylquinoxaline 2.5 g
4-Mercaptobutyric acid 1.8 g The fixing bath contains, per liter of solution:

Ammonium thiosulfate 200 g
Ammonium bisulfite 12 g
Ammonium sulfite 39 g

The evaluation of the processed materials gives the following sensitometric values:

| Material with layer | Minimum density | Maximum density | log sensitivity at 0.5 $D_{max}$ |
|---|---|---|---|
| a (comparison) | 0.037 | 1.16 | 0.87 |
| b | 0.037 | 1.22 | 0.82 |
| c | 0.038 | 1.23 | 0.93 |

The results show that the colloidal dispersions of the dye of the formula (100) can be bleached with the same ease as the comparison material. The materials with the layers b and c do not contain any microscopically visible dye particles and have a homogeneous dye distribution.

EXAMPLE 18

Two photographic magenta layers d and e for the silver dye bleach process are prepared, which each contain, on a transparent polyester base, 1.6 $g.m^{-2}$ of gelatine, 0.35 $g.m^{-2}$ of silver as a green-sensitized silver bromoiodide emulsion and 0.155 $g.m^{-2}$ of the magenta dye of the formula (101) and, on top, a protective gelatine layer which contains 1.0 $g.m^{-2}$ of gelatine and 0.08 $g.m^{-2}$ of the gelatine hardener according to Example 17.

Layer d (comparison) contains the dye as the sodium salt, and the coating solution for this case is prepared in the conventional manner by adding the aqueous dye solution to the green-sensitized silver halide emulsion.

Layer e contains the dye in the form of a colloidal dispersion of the calcium salt, as described in Example 7.

The two materials are exposed to green light in the conventional manner and are processed as described in Example 17.

The following sensitometric results are obtained:

| Material with layer | Minimum density | Maximum density | log sensitivity at 0.5 $D_{max}$ |
|---|---|---|---|
| d (comparison) | 0.042 | 1.02 | 0.75 |
| e | 0.037 | 1.04 | 0.74 |

The colloidal dispersion of the calcium salt of the dye of the formula (101) can be bleached with the same ease as the comparison material.

EXAMPLE 19

The colloidal dispersion of the calcium salt of the dye of the formula (100) is first prepared as described in Example 2. 28 g of a silver bromoiodide emulsion which contains 2.6 mol % of iodide and 56.5 g of silver/kg are then added. After the addition of 5 ml of a 0.0416% solution of the red-sensitizer of the formula

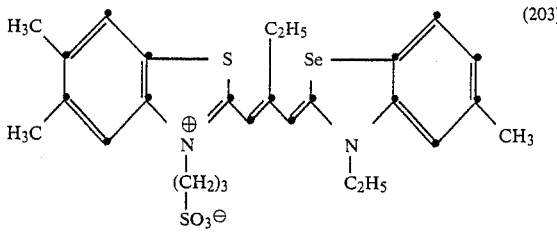

(203)

in methanol, the mixture is digested for 20 minutes at 40° C. and then coated in the conventional manner on a transparent polyester base, together with a protective gelatine layer of 1.0 $g.m^{-2}$ of gelatine and 0.08 $g.m^{-2}$ of the gelatine hardener according to Example 17. The dye layer contains 2.0 g of gelatine, 0.40 g of silver and 0.215 g of cyan dye per $m^2$ of layer base (material F).

A comparison material (material G) is prepared in the same way, but the calcium nitrate solution is replaced by the same volume of water.

The two materials are exposed and processed as described in Example 17. This gives the following sensitometric values:

| Material | log E at 0.5 $D_{max}$ |
|---|---|
| F | 0.81 |
| G (comparison) | 2.41 |

It can be shown spectroscopically that, in the case of sensitization in the presence of the dye solution, the formation of a J band (sensitivity maximum at ≈660 nm) is prevented, whereas a pronounced J band at about 660 nm is formed in the presence of the calcium dispersion.

The same results are obtained when the barium salt as described in Example 3 is used in place of the calcium salt.

EXAMPLE 20

A colloidal dispersion of the calcium salt of the dye of the formula (102) is prepared, as described in Example 11. The dispersion contains 9.65 g of gelatine, 19.9 ml of 0.1M calcium nitrate solution and 1.25 g of the dye of the formula (102). 62 g of a silver bromoiodide emulsion having a silver content of 56.5 g of silver/kg and 2.6 mol % of iodide are then added. For spectral sensitization, 18.7 mg of blue-sensitizer of the formula

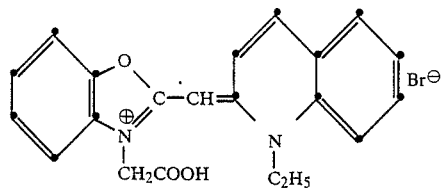

(200)

dissolved in methanol are added, and the mixture is digested for 20 minutes at 40° C. The mixture is coated in the conventional manner on a transparent polyester base together with a protective gelatine layer which contains 1 $g.m^{-2}$ of gelatine and 0.08 $g.m^{-2}$ of the gelatine hardener according to Example 17 (material H).

In the same way, a material J is prepared which, however, after sensitization with the sensitizer of the formula (200), was also digested with 0.48 mg of the super-sensitizer of the formula

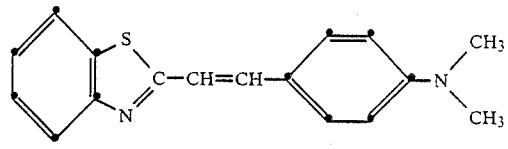

(201)

For comparison, the materials K and L are prepared which contain an aqueous solution of the dye of the formula (102) in place of the colloidal dispersion of the calcium salt of the dye of the formula (102).

The four materials are exposed and processed as described in Example 17, and the following sensitometric values are obtained:

| Material | log E at 0.5 $D_{max}$ | gamma |
|---|---|---|
| H | 0.63 | 2.42 |
| K (comparison) | 0.79 | 2.21 |
| J | 0.27 | 2.65 |
| L (comparison) | 0.75 | 2.29 |

FIGS. 1 to 4 show the wedge spectrogrammes of the materials H to L (lines of equal density at 30, 50 and 70% of maximum density).

The results show that the sensitizer of the formula (200) forms a J band at 490 nm only if the dye of the formula (102) is used, according to the invention, in the form of its calcium dispersion. The super-sensitization with the compound of the formula (201) also is effective only with the material J according to the invention and gives a sensitivity which is higher by 0.36 log units.

EXAMPLE 21

A monodisperse cubic silver chlorobromide emulsion having a mean edge length of 0.22 μm and a chlorine content of 20 mol % is spectrally sensitized with 648 mg of the green-sensitizer of the formula

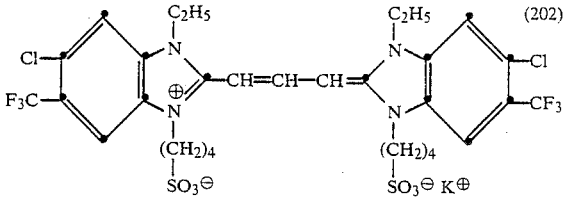

(202)

per mole of silver halide and stabilized with 5-methyl-7-hydroxy-2,3,4-triazaindolizine.

The emulsion is divided into two parts (21/1 and 21/2). A colloidal dispersion of the lanthanum salt of the dye of the formula (101), the preparation of which is described in Example 6, was added to part 21/1. The dye of the formula (101) is added as an aqueous solution to part 21/2 (comparison).

The two mixtures each contain 3.03 g of the dye of the formula (101), 6.75 g of silver and 30 g of gelatine per kg.

The mixtures are digested at 40° C. and, after various holding times at 40° C., coated onto a transparent polyester base, together with a protective gelatine layer of 1.0 $g.m^{-2}$ of gelatine and 0.08 $g.m^{-2}$ of the gelatine hardener according to Example 17.

The various samples are exposed and processed as described in Example 17, and the following log sensitivities, measured at 50% of the maximum density, are obtained:

| Holding time at 40° C. | La dispersion of (100) | Aqueous solution of (101) |
|---|---|---|
| 0 | 0.65 | 0.72 |
| 2 hours | 0.69 | 0.96 |
| 4 hours | 0.70 | 1.13 |
| 6 hours | 0.70 | 1.15 |

The results show that the use, according to the invention, of the dye of the formula (101) in the form of its lanthanum dispersion gives a higher sensitivity and a substantially smaller change (decrease) in sensitivity during the holding time.

EXAMPLE 22

A photographic copying material for the silver dye bleach process is prepared. For this purpose, the following layers are applied to a polyethylene-coated paper base: a gelatine base coat of 1.2 $g.m^{-2}$ of gelatine, a red-sensitive layer which, per $m^2$, contains 1.0 g of gelatine, 0.28 g of silver as a silver bromoiodide emulsion with 2.6 mol % of iodide and 155 mg of the cyan image dye of the formula (100) as a colloidal dispersion of the calcium salt,

- a gelatine interlayer of 1.5 $g.m^{-2}$ of gelatine and 5 $mg.m^{-2}$ of calcium chloride,
- a green-sensitive layer which, per $m^2$, contains 1.4 g of gelatine, 0.24 g of silver as a silver bromoiodide emulsion with 2.6 mol % of iodide and 165 mg of the magenta image dye of the formula (101) as a colloidal dispersion of the calcium salt,
- a yellow filter layer of 1.6 $g.m^{-2}$ of gelatine, 0.04 $g.m^{-2}$ of colloidal silver and 0.054 $g.m^{-2}$ of the yellow dye of the formula (102),
- a blue-sensitive layer, which, per $m^2$, contains 0.9 g of gelatine, 0.22 g of silver as a silver bromoiodide emulsion with 2.6 mol % of iodide and 80 mg of the yellow dye of the formula (102) as a colloidal dispersion of the calcium salt, and a protective gelatine layer of 0.8 $g.m^{-2}$ of gelatine.

In addition, the material contains 0.23 g of the gelatine hardener according to Example 17.

For comparison, a copying material of the same structure and the same composition is prepared but, in place of the colloidal dispersion of the calcium salts of the image dyes, the alkali metal salts of the image dyes are used in the form of aqueous solutions.

The two materials are exposed in the conventional manner and processed as described in Example 17.

The material according to the invention is more sensitive than the comparison material by 0.16 log units and, for grey matching, requires filtration of 30 yellow and 15 magenta, whereas filtration of 21 yellow and 34 magenta is necessary for the comparison material.

In an analysis of colour rendering, 10 different test colours are investigated in the CIELAB colour space (G. Wyszecky and W. S. Stiles, "Color Science", 2nd edition, John Wiley and Sons, 1982, page 829). 7 colours of these 10 test colours are markedly better rendered by the material according to the invention than by the comparison material. Table 1 shows the coordinates of the original colours in the CIELAB colour space and the colour changes DE in the material according to the invention and in the comparison material. A smaller colour change DE signifies a better rendering of the colour.

In microscopic thin layers, a diffusion of the dye of the formula (100) into the gelatine base coat and into the gelatine interlayer is detectable in the comparison material, whereas no diffusion is visible in the material according to the invention.

TABLE 1

| | Test colour | | DE | DE |
|---|---|---|---|---|
| L | a | b | (Invention) | (Comparison) |
| 54.4 | −25.7 | −42.3 | 19.6 | 20.3 |
| 71.8 | −14.3 | −23.4 | 16.4 | 16.8 |
| 49.2 | 72.0 | −14.9 | 9.4 | 17.3 |
| 68.0 | 38.8 | −9.4 | 22.5 | 27.7 |
| 82.0 | 17.2 | −4.5 | 16.1 | 19.1 |
| 86.7 | −12.5 | 90.7 | 14.7 | 23.0 |
| 47.2 | 58.6 | 50.2 | 9.6 | 16.4 |
| 46.2 | −66.6 | 26.5 | 22.7 | 30.1 |
| 21.9 | 38.5 | −60.9 | 28.2 | 31.2 |
| 94.0 | −1.3 | 1.0 | 3.1 | 3.4 |

L = luminance
a = green/red
b = blue/yellow
DE = colour difference (between the copy and the original)

What we claim is:

1. A photographic material for the silver dye bleach process, which comprises, in at least one layer, a colloidal dispersion of water-insoluble salts of water-soluble azo dyes, capable of laking, in gelatin, the colloidal particles having a size of 0.01 to 1 m and the ratio of azo dye to gelatin being 1:1 to 1:10 the colloidal dispersion being obtained by reacting the azo dyes with at least the stoichiometric quantity of divalent or trivalent inorganic metal salts in the presence of gelatin.

2. The photographic material according to claim 1, wherein the metal salts are salts of magnesium, calcium, strontium, barium, zinc, cobalt, nickel, lanthanum, the lanthanides or mixtures of these salts.

3. A photographic material according to claim 2, wherein the metal salts are salts of magnesium, calcium, barium or lanthanum.

4. A photographic material according to claim 3, wherein the metal salts are salts of barium.

5. A photographic material according to claim 1, wherein the azo dyes are of the formula

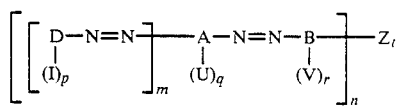

(1)

in which A, B and D independently of one another are phenyl or naphthyl, these radicals being unsubstituted or substituted by hydroxyl, amino, $—NHR_1$ or $—N(R_2)_2$, in which $R_1$ and $R_2$ are alkyl having 1 to 8 carbon atoms, $—C_2H_4OH$, $—COR_3$ with $R_3$ being alkyl having 1 to 10 carbon atoms, phenyl, phenyl substituted by halogen, alkoxy, acylamino, alkylcarbonyl, alkylsulfonyl or halogenoalkyl each having 1 to 4 carbon atoms in the alkyl moiety, or carboxyl,

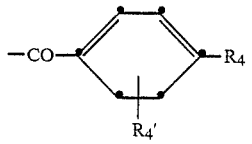

in which $R_4$ and $R_4'$ independently of one another are hydrogen, halogen, nitro, trifluoromethyl, alkyl or alkoxy each having 1 to 4 carbon atoms, —NHCOX, $NHSO_2Y$, —COZ or $—SO_2Z$, in which X is hydroxyl, $HO_2C$-alkyl, $HO_2C$-alkenyl, $HO_2C$-phenyl, $HO_3S$-phenyl, phenyl, furanyl, thienyl or pyridyl, Y is alkyl, phenyl, alkylphenyl or $HO_2C$-phenyl and Z is alkyl or amino, or $R_1$ and $R_2$ are

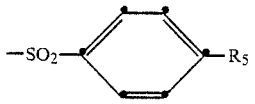

in which $R_5$ is hydrogen, methyl or chlorine, or

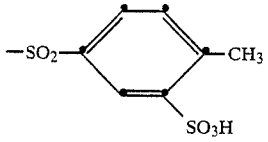

and $R_1$ can also be a radical of the formula

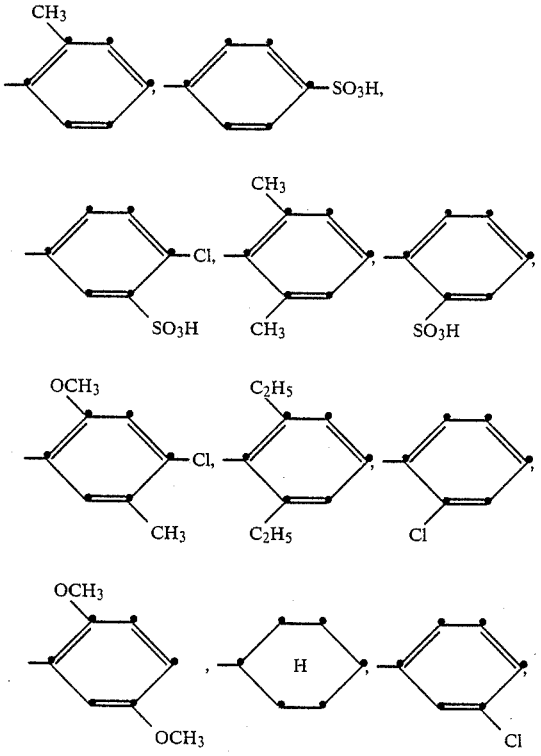

-continued

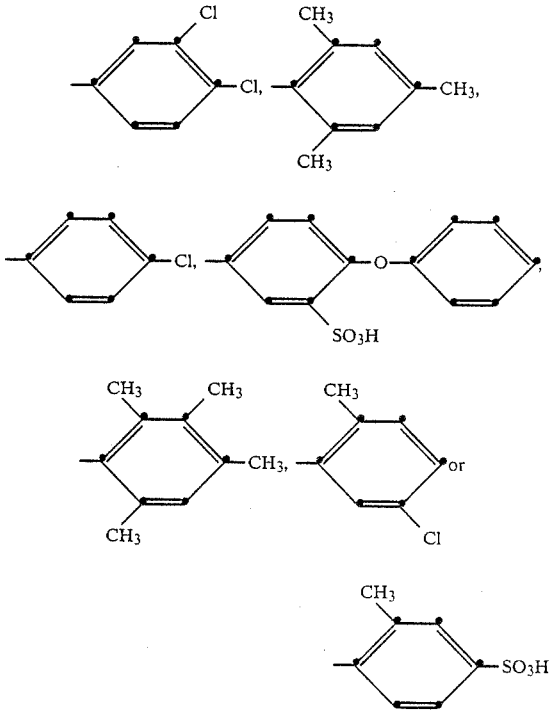

or A, B and D independently of one another may be substituted by $—OCH_3$, $—OC_2H_5$, $—OC_2H_4OH$, $—OC_2H_4OCH_3$, $—OC_2H_4OC_2H_4OH$, $—SCH_3$, $—SC_2H_5$, $—SO_2CH_3$, $—SO_2C_2H_5$, $—SO_3C_4H_9$ or $—CO_2R_6$ or $—OCOR_6$, in which $R_6$ is alkyl having 1 to 5 carbon atoms or phenyl, I, U and V are $—SO_3M$ or $—CO_2M$, in which M is hydrogen, sodium or potassium, Z is, if n=2, a bridge member linked by an —NH— group to the adjoining aromatic radicals B or, if n=1, is a radical of the formula

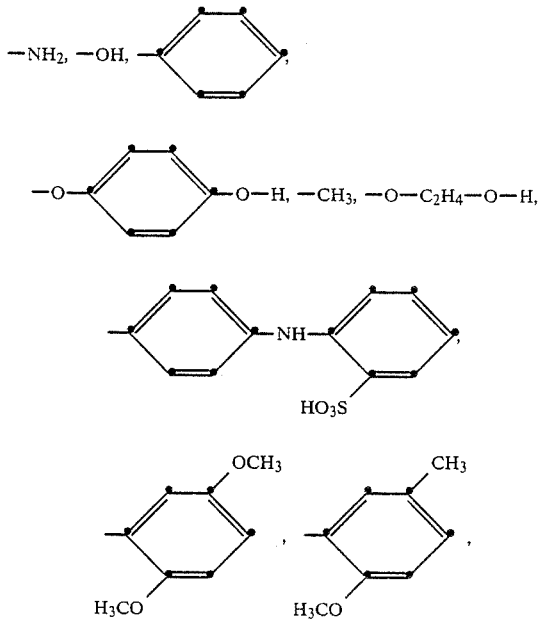

-continued

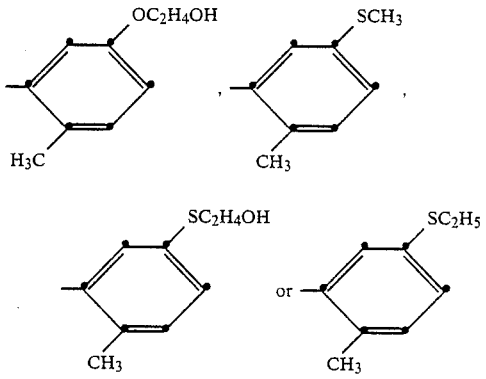

linked directly to B, m is 0, 1 or 2, n is 1 or 2, p, q and r are 0, 1, 2 or 3 and t is 0 or 1.

6. A photographic material according to claim 5, wherein the azo dyes contain at least 2 sulfo groups.

7. A photographic material according to claim 6, wherein the azo dyes contain at least 3 sulfo groups.

8. The photographic material according to claim 6, wherein the colloidal dispersion is obtained by reacting the azo dyes with the metal salts at a temperature of 30° to 60° C. and a pH of 5 to 8.

9. A photographic material according to claim 8, wherein the temperature is 40° to 50° C. and the pH is 6 to 7.

10. A photographic material according to claim 1, wherein the gelatine concentration in the colloidal dispersion is 1 to 8%.

11. The photographic material according to claim 10, wherein the gelatine concentration is 2 to 6%.

12. A photographic material according to claim 5, which comprises, in at least one layer, a colloidal dispersion in gelatine of water insoluble calcium, barium or lanthanum salts of azo dyes of the formula (1), in which A, B and D independently of one another are phenyl or naphthyl, these radicals being unsubstituted or substituted by hydroxyl, amino or $—NHR_1$, in which $R_1$ is

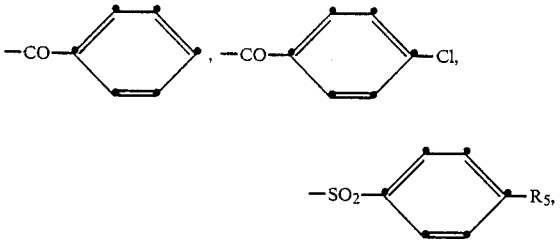

in which $R_5$ is hydrogen, methyl or chlorine,

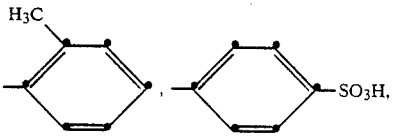

-continued

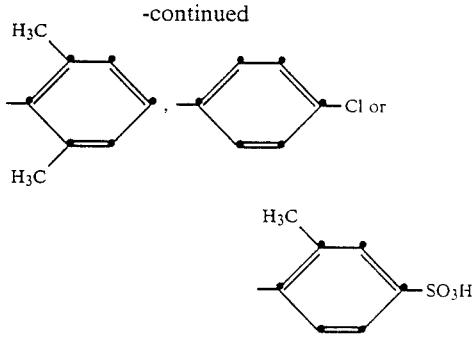

or A, B and D independently of one another may be substituted by $—OCH_3$, $—OC_2H_5$, $—OC_2H_4OH$, $—SC_2H_5$, $—SO_2CH_3$, $—SO_2C_2H_5$, $—SO_3C_4H_9$ or $—CO_2R_6$ or $—OCOR_6$ in which $R_6$ is alkyl having 1 to 5 carbon atoms or phenyl, I, U and V are $—SO_3M$, in which M is hydrogen, sodium or potassium, Z is, if n=2, a bridge member linked via an —NH— group to each of the adjoining aromatic radicals B or, if n=1, is a radical of the formula

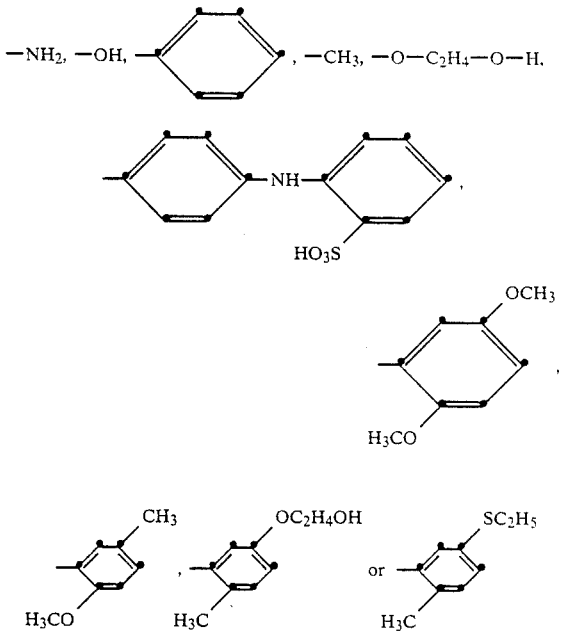

linked directly to B, and m, n, p, q, r and t are as defined in claim 6, the colloid particles having a size of 0.01 to 0.5 μm and the ratio of azo dye to gelatine being 1:2 to 1:10.

13. The photographic material according to claim 12, wherein the ratio of azo dye to gelatine is 1:2 to 1:6.

14. The photographic material according to claim 1, which contains, additionally to the colloidal dispersion and in the same layer, a silver halide emulsion which may be sensitized or super-sensitized.

15. A process for preparing the photographic material according to claim 1, which comprises incorporating into the material at least one layer which contains a colloidal dispersion of water-insoluble salts of water-soluble azo dyes, capable of laking, in the gelatin, the colloid particles having a size of 0.01 to 1 μm and the ratio of azo dye to gelatin being 1:1 to 1:10 the colloidal dispersion being obtained by reacting the azo dyes with at least the stoichiometric quantity of divalent or trivalent inorganic metal salts in the presence of gelatin.

16. The colloidal dispersion used in the material according to claim 1.

* * * * *